United States Patent [19]

Eiler

[11] Patent Number: 4,466,337

[45] Date of Patent: Aug. 21, 1984

[54] ELECTRO HYDRAULIC CONTROL WITH DEAD ZONE COMPENSATION

[75] Inventor: Alan H. Eiler, Bloomington, Minn.

[73] Assignee: Sundstrand Corporation, Rockford, Ill.

[21] Appl. No.: 342,624

[22] Filed: Jan. 25, 1982

[51] Int. Cl.[3] ..... F15B 13/044

[52] U.S. Cl. ..... 91/506; 137/625.65; 251/129

[58] Field of Search ..... 60/443; 91/506; 137/625.65; 251/129, 131; 361/154, 208

[56] References Cited

U.S. PATENT DOCUMENTS

| | | | |
|---|---|---|---|
| 3,763,745 | 10/1973 | Andersen | 91/186 |
| 3,826,174 | 7/1974 | Platt et al. | 91/363 |
| 3,946,284 | 3/1976 | Dieringer | 317/123 |
| 4,077,674 | 3/1978 | Doto | 303/40 |
| 4,103,695 | 8/1978 | Aono | 137/1 |

*Primary Examiner*—Gerald A. Michalsky

*Attorney, Agent, or Firm*—James A. Wanner; Ted E. Killingsworth; Michael B. McMurry

[57] ABSTRACT

The present invention is directed to an electro hydraulic control system wherein electric current output of the control is applied to an electric force motor to position a valve spool which in turn modulates fluid flow to a device to be controlled. The valve spool, either to accommodate manufacturing tolerance or to assure zero output flow, in the neutral position, has a flow dead zone which requires a substantial valve spool travel to initiate fluid flow through the valve. In the preferred device the manual control handle modulates the current output of the electric circuit which in turn proportionately modulates the position of the valve spool. The electric circuit is provided with resistance means which are selectively inserted into the circuit to assure that sufficient output current is provided to the force motor to move the valve spool that amount necessary to initiate fluid flow upon a small movement of the control handle to compensate for the fluid flow dead zone in said valve.

14 Claims, 5 Drawing Figures

ELECTRO HYDRAULIC CONTROL WITH DEAD ZONE COMPENSATION

TECHNICAL FIELD

This invention pertains to an electro hydraulic control system wherein an electric circuit is used to modulatingly control the flow through a hydraulic valve, the valve having a movable valve element which moves from a neutral position preventing fluid flow to a flow position permitting fluid flow. By modulating the amount of movement of the valve element, the amount of flow through the valve is controlled. Control valves of this type, due to manufacturing tolerances, normally require a certain amount of movement of the valve element from the neutral flow position before flow through the valve is initiated. The zone of movement between the neutral position which guarantees no flow and the position of the valve element which first initiates the flow through the valve is herein referred to as "dead zone".

BACKGROUND ART

Prior art electro hydraulic control systems have utilized an electric circuit having a varying current output through an electric motor device such as an electric force motor which modulatingly positions a movable valve element such as a valve spool which is axially movable within a valve bore. The amount of axial movement of the valve spool is generally proportional to the amount of current of the electric circuit. Furthermore, such prior art devices modulate the current output of the control circuit by input means which in the simplest form can consist of a manually positioned control handle. Incremental movement of the control handle proportionally controls the current output of the control circuit which in turn proportionally controls the axial position of the valve spool. One such example in the prior art is the MCH 100 control handle sold by Honeywell Corporation.

The incremental movement of the prior art positioning devices along with their electric circuitry do not compensate for the movable valve element "dead zone" mentioned above. Therefore, the initial movement of the positioning means from a zero current output position causes an increase in current flow to the electric force motor which in turn starts to move the valve spool, but since the valve spool is in the dead zone, this does not immediately initiate hydraulic flow through the servo valve.

SUMMARY OF THE INVENTION

The primary feature of the invention disclosed herein is to provide compensation means to create a substantial current flow to an electric force motor controlling a servo valve spool upon initial movement of positioning means for the electric circuit.

In furtherance of the foregoing, an object of the present invention is to provide a simple method of obtaining an initial step in control circuit output current to an electro hydraulic control valve as the control positioning means such as a control handle is initially moved off a center "no-flow" position and thus overcome a hydraulic flow dead zone of the valve.

Furthermore, it is an object of the present invention to extend the control range of an electro hydraulic control servo valve by reducing the amount of movement of a manual control handle necessary to overcome a hydraulic flow dead zone in the servo valve.

Furthermore, it is an object of the present invention to provide an electric hydraulic control system for a variable displacement pump wherein the initial command is provided by a manual control handle wherein simple means are provided to assure that movement of the control handle from a neutral position substantially immediately produces a change in displacement of the pump.

It is a further object of the present invention to provide an electro hydraulic control circuit for an electrically controlled hydraulic valve having a valve spool movable between a neutral position preventing flow through the valve and a flow position permitting flow through the valve and wherein the valve spool moves an incremental amount before flow through the valve begins, an electric motor for moving the valve spool from the neutral position to the flow position when electric current is supplied to the electric motor and wherein the amount of movement of the valve spool is proportional to the electric current, an electric circuit for controlling the amount of current supplied to the electric motor, control positioning means for modulating the current output of the circuit proportional to displacement of the control positioning means and having a zero current output position, the improvement comprising means in the circuit for substantially increasing the current output of the circuit upon a small movement of the positioning means from the zero current output position, the substantial increase of current output being sufficient to move the valve spool the incremental amount.

DESCRIPTION OF THE PREFERRED EMBODIMENT

Figure 1:
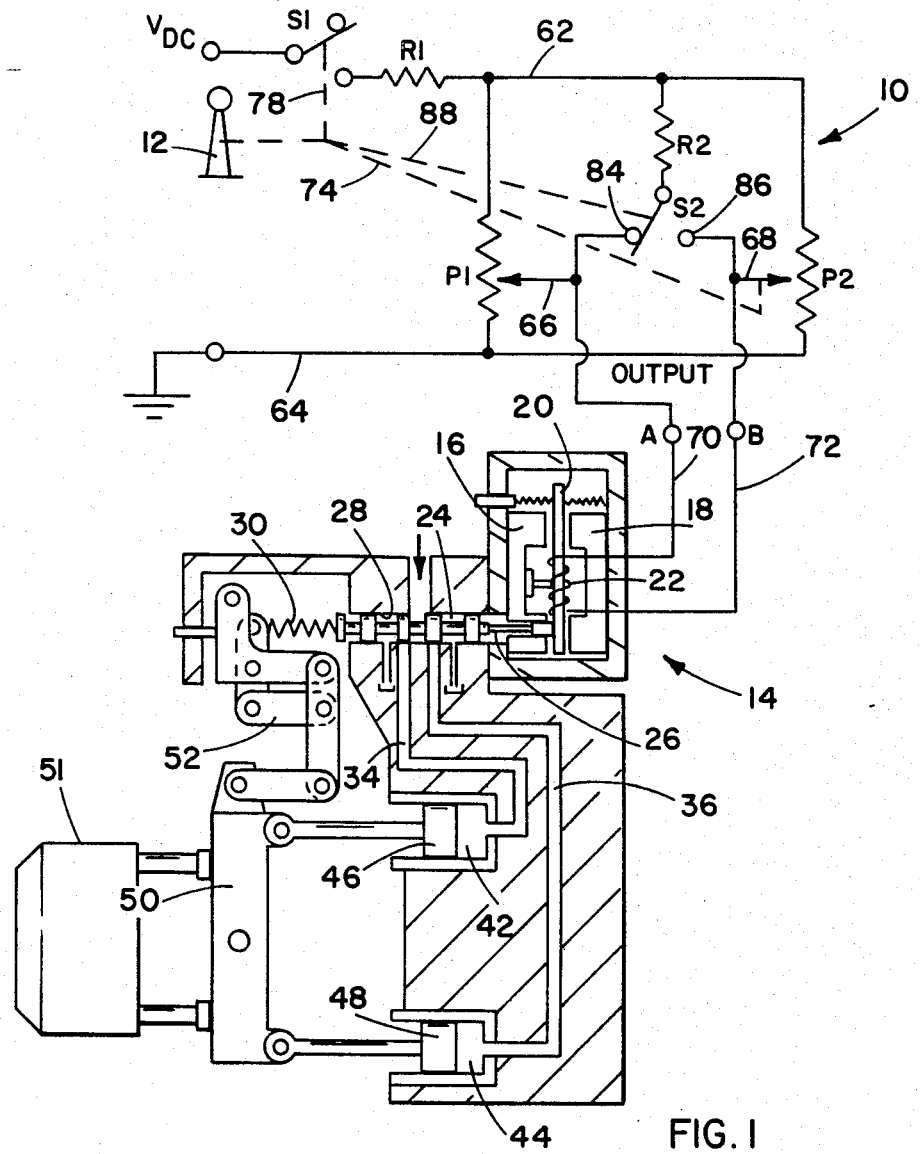
FIG. 1 is a schematic diagram showing the electric control circuit of the present invention as applied to a servo valve for a variable displacement pump.

The preferred embodiment of the electro hydraulic control system of the present invention is shown in FIG. 1 as would be used for controlling the output flow of a variable displacement pump. Control circuit 10 has a manual input by means of a control handle 12 which is utilized to vary the current output of the circuit 10. When the control handle 12 is in a centered or neutral position there is no current output from the circuit 10. As the control handle 12 is moved from said neutral position, the current output from the control circuit 10 to an electromotive device such as an electric force motor 14, is increased. The electric force motor commonly includes two magnetic poles such as permanent magnets 16 and 18 with an armature 20 spring biased to a neutral position therebetween. The armature 20 is centrally pivoted and is provided with a coil 22 which is connected to the output of circuit 10 at junctions A and B. Current flow through the coil 22 generates a magnetic field in the armature 20 which cooperates with the permanent magnets 16 and 18 to cause pivotal movement of the armature 20 which in turn axially positions a flow control element such as valve spool 24 by means of a pin or pushrod 26. Valve spool 24 is axially movable within a valve bore 28. A spring 30 biases the spool 24 and the pushrod 26 to the right against the armature 20.

Figure 2:
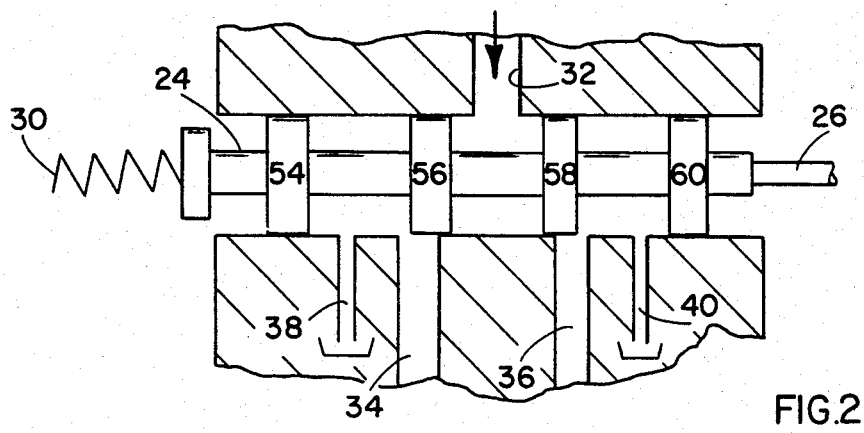
FIG. 2 is an enlarged sectional view showing the servo valve of FIG. 1.

An enlarged view of the servo valve in its neutral "no-flow" position is shown in FIG. 2. The valve bore 28 is connected to a source of control fluid "P" by means of an inlet passage 32. The valve spool, having a plurality of lands described below, controls the flow of hydraulic fluid from the inlet 32 to two outlet passage ways 34 and 36 which are also connected to the valve bore 28. Furthermore two drain passageways 38 and 40 are connected to the valve bore outboard of the two outlet control passageways 34 and 36.

Referring again to FIG. 1, the two outlets 34 and 36 of the servo valve in one preferred environment of the present invention are connected to servo cylinders 42 and 44 respectively. Servo cylinders 42 and 44 have pistons 46 and 48 which are connected to a centrally pivoted swash plate 50 of a variable displacement pump 51 which could also be provided with a feedback linkage 52. The electric force motor 14 and servo valve are well known commercially available items used with variable displacement pumps in the arrangement shown in FIG. 1. Varying the current in coil 22 modulates the position of the servo valve to control the hydraulic fluid flow to the two servo cylinders which in turn modulate the position of the swash plate 50.

It is noted that the valve spool 24 is provided with valve lands 54, 56, 58 and 60 as shown in FIG. 2. In the neutral position of valve spool 24, lands 56 and 58 prevent the flow of control fluid from inlet 32 to the outlets 34 and 36. When the valve spool is moved toward the right, valve spool land 58 uncovers outlet 36 permitting the flow of control fluid from inlet 32 through conduit 36 to the servo cylinder 44 and valve land 56 has uncovered conduit 34 so that servo cylinder 42 is connected to drain line 38. This causes swash plate 50 to move in a clockwise direction around its central pivot. Movement of valve spool 24 toward the left reverses the fluid connections. Land 56 now uncovers conduit 34 to connect the hydraulic inlet line 32 to servo cylinder 42 to cause counterclockwise movement of the swash plate 50. In this position, servo cylinder 34 is now connected to drain 40.

It is particularly noted that in the neutral position shown in FIG. 2, the left hand edge of land 58 is displaced an incremental distance to the left from the edge of conduit 36 while the right hand edge of land 56 is displaced an incremental distance to the right of conduit 34. Such valve construction is common in order to assure that there is no flow of control fluid from inlet 32 to either of the outlet passages 34 or 36 when the valve spool is in the neutral position. Such overlap of the valve lands relative to the outlet conduits is necessary due to manufacturing tolerances and sometimes accounts for one-third of the total valve spool movement. It is this overlap of the lands relative to the outlet conduits 34 and 36 that creates the so-called "dead zone" of the hydraulic servo valve. Because of this dead zone, small movements of the valve spool 24 to either the right or the left does not permit control fluid to flow to the servo cylinders. It is only after such incremental movement that controlled hydraulic flow is generated.

Thus small movements of the control handle 12 in either direction will cause the electric circuit 10 to produce a small flow of electrical current which in turn will cause small angular displacement of the armature 20 of the electric force motor 14. However, the small incremental movement of the valve spool 24 to the right or left does not generate the flow of control fluid due to the dead zone. Therefore some means need be provided to generate sufficient electrical current to the force motor 14 to cause sufficient movement to the valve spool 24 to overcome the dead zone upon small movements of the control handle 12.

The control circuit 10 is provided with lines 62 and 64 which are connected across a source of voltage such as a 12 volt battery. Alternatively, the voltage supply may be the output of another control device or other voltage source. Connected in parallel across lines 62 and 64 are two variable resistors such as potentiometers P1 and P2. The wipers 66 and 68 of the two potentiometers are connected to both sides of the coil 22 via lines 70 and 72. The center connection of the potentiometers P1 and P2 forms a variable resistive bridge which controls the current output to the coil 22. Furthermore, a resistor R1 may be placed in line 62 from a voltage divider which determines the voltage drop across the potentiometer bridge. Different values of R1 may be utilized to provide the proper full stroke current for a given force motor 14.

Figure 3:
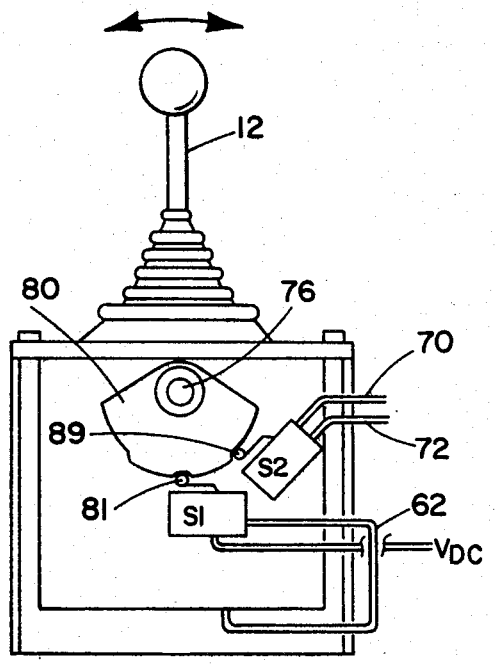
FIG. 3 is a cross-sectional view of a control handle showing the switching arrangement of the present invention.

The wiper arms 66 and 68 of the two potentiometers are connected to the control handle 12 by means of mechanical connection 74 shown by dotted lines in FIG. 1. One commercially available device, Honeywell control handle MCH 100, the mechanical connection between the control handle 12 and the potentiometer wipers is provided by means of gearing. With this device, movement to the right or left of the control handle 12 shown in FIG. 3 causes clockwise or counterclockwise movement of shaft 76. Rotation of the shaft 76 (gearing not shown) causes the wipers 66 and 68 of the potentiometers P1 and P2 to move in opposite electrical directions. Furthermore, in such device handle 12, by means of a mechanical connection 78, operates a switch S1 which connects line 62 to a positive terminal of a battery. Mechanical connection 78 is in the form of a cam 80 shown in FIG. 3 having a central notch 81 which is engaged by the operating arm of switch S1. When the handle 12 is in the neutral or vertical position, the operating arm of switch S1 is in the detent or notch 81 opening the switch S1 and thus preventing current flow through potentiometer bridge and thus in turn assuring that there is no current to the coil 22 of the electric force motor 14. Movement of the cam 80 by rotation of shaft 76 causes the cam to close the contact of switch S1 to apply voltage across the potentiometer bridge.

Furthermore, when the control handle 12 is in its neutral position the wipers 66 and 68 of potentiometers P1 and P2 respectively are centered on the variable resistance. Since the total resistance of both potentiometers are identical and since the wipers 66 and 68 are centered, the bridge is balanced or in a null position and thus there is no current output to coil 22. Movement of the control handle 12 causes opposite direction movement of the two potentiometer wipers and thus unbalances the bridge to cause current output to the coil 22.

Figure 4:
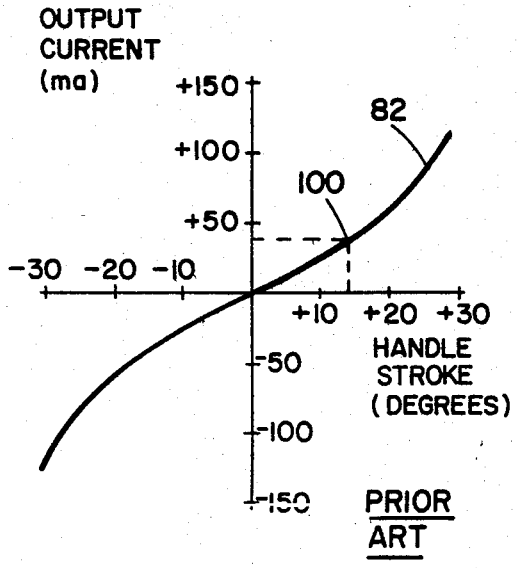
FIG. 4 is a graph showing a characteristic output current as a function of handle stroke of a prior art device.

This prior art device provides an output current to handle stroke relationship as shown by line 82 in the graph of FIG. 4. It is noted that small incremental movements of the handle 12 both in the positive and negative direction create a small increase or decrease respectively in the output current relative to the zero output current when the handle is in its neutral or zero stroke position. Such small current, while causing small angular movement of the armature 20 of the force motor 14 and thus small axial movement of the valve spool 24, is insufficient to overcome the dead zone of the valve as mentioned above.

In order to overcome the valve dead zone, electric circuit 10 of the present invention includes a resistor R2 connecting line 62 to double throw switch S2. Contact 84 of switch S2 connects resistor R2 to line 70. The other contact 86 connects the resistor R2 to line 72. When S2 engages contact 84, the parallel relationship of resistor R2 and the upper portion of potentiometer P1 above wiper 66 causes an effective decrease in resistance relative to output terminal A and thus increases the current output to the coil 22 in a first or positive direction. When S2 connects contact 86 to R2, thus placing the upper portion of potentiometer P2 above wiper 68 and R2 in parallel, there is an effective decrease in resistance which increases current output in a second or negative direction to coil 22.

The switch S2 is also operated by the control handle 12 by mechanical connection 88. In the preferred form shown in FIG. 3. this is provided by a rise 89 of cam 80. When the control handle 12 is in its vertical or neutral position, the operating arm of switch S2 is positioned at the rise 89. When control handle 12 is moved toward the right, cam 80 rotates clockwise allowing the operating arm of S2 to engage a smaller radius of the cam adjacent the rise 89 wherein contact 84 is closed. Movement of the control handle 12 to the left causes counterclockwise rotation of the cam 80 wherein the operating arm of switch S2 engages the larger radius portion of the cam to the left of rise 89 thus causing switch S2 to engage contact 86. The exact positioning of the switch S2 operating arm on the cam rise 89 when the control handle 12 is in the neutral position is not critical since cam notch 81 opens switch S1 thus preventing current output at this time.

Figure 5:
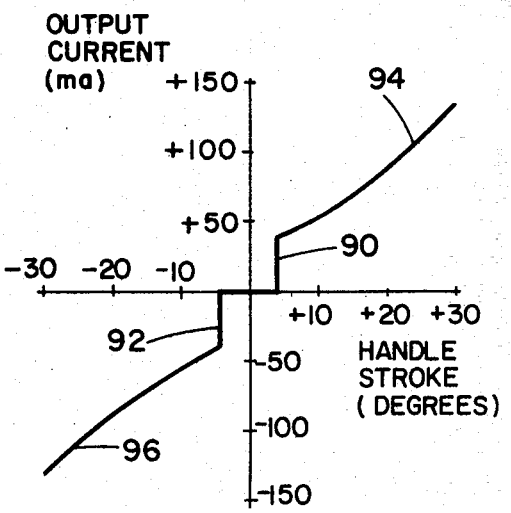
FIG. 5 is a graph showing a characteristic output current as a function of handle stroke of the present invention.

The current output, of the control circuit 10 including resistance R2 and switch S2, relationship to displacement of the handle 12 is shown in the graph of FIG. 5 which is of similar scale to the graph of FIG. 4. Assuming a total handle stroke of 60°, that is 30° in the positive direction and 30° in the negative direction, movement of the control handle of approximately 3° in either direction from the center causes switch S1 to close. Within the 6° travel of cam 80 either contact 84 or contact 86 of switch S2 has been engaged thus connecting resistor R2 to either line 70 or line 72. When switch S1 is closed there is an immediate rise in the output current in a positive direction as represented by line 90 or in the negative direction as represented by line 92 in the graph of FIG. 5. It is noted that the remainder of the curve representing output current relative to handle stroke as shown by line 94 in the positive quadrant and by line line 96 in the negative quadrant is somewhat similar to but of lesser slope than the curve 82 in the prior art graph of FIG. 4.

As is readily discernible when viewing the graph of FIG. 5 relative to the graph of FIG. 4, the main difference is that small movements of the handle stroke in either a positive or negative direction causes a substantial instantaneous increase in the current output of the improved control circuit 10. The substantial increase in output current as represented by lines 90 and 92 when the control handle is moved a small amount in either a positive or negative direction provides a substantial increase in current to the coil 22 of the force motor 14 which causes a substantial angular movement of the armature 20 to that degree necessary to cause enough axial movement of the valve spool 24 to overcome the dead zone mentioned above.

In this example it is assumed that R1 has a value of 30 ohms, R2 has a value of 75 ohms, and the total resistance value of each of the potentiometers of P1 and P2 is 200 ohms. These values of course may be modified for various controls to provide the necessary incremental movements of the valve spool 24 to overcome the dead zone.

The improved electro hydraulic control system utilizing the resistance R2 and the switch S2 furthermore provides the advantage of an increased range for the proportional control of the axial movement of the valve spool 24. As noted above, the amount of travel of the valve spool within the dead zone may be significant and furthermore the amount of spool travel is directly proportional to the output current through terminals A-B of the electric circuit output. As one example, assume that 40 milliamps of output current is necessary to provide that increment of valve travel to bring the left hand edge of valve spool land 58 into alignment with the left hand edge of outlet port 36. Referring to the graph of FIG. 4 wherein curve 82 represents the relationship between current output and handle stroke for the prior art device, it is noted that in order to obtain 40 milliamps output current, the handle 12 must be stroked approximately 14°. This is represented by point 100 on the curve 82. If the handle has a total travel of 30° in the positive direction, and since approximately 14° of handle stroke is necessary to overcome the dead zone, only 16° of handle stroke is available for the proportional control of the valve spool travel in the flow modulation zone. Referring to the graph of FIG. 5 which represents the output current relationship to handle stroke for the improved control, it is noted that 40 milliamps of output current is obtained at the juncture of line 90 and curve 94. This occurs at approximately 3° of handle stroke as mentioned above. Thus, there is a full 27° of handle stroke available for use in modulating the flow through the valve.

Furthermore it is noted that the maximum current output for both the prior art device and the improved device are approximately equal. Since the current output zone above the 40 milliamps necessary to overcome the dead zone takes place over a greater handle displacement for the improved device (27° as compared to 16°) the slope of curve 94 is substantially reduced when compared to the slope of curve 82. This provides a 1.7 greater range of control with a corresponding higher degree of accuracy since for any incremental movement of the handle 12, there is a lesser change in the output current. In the improved electro hydraulic control system, only 3° of handle stroke is necessary to overcome the dead zone leaving 27° of handle stroke to be utilized for full range control. This reduces the sensativity of current output relative to a given control handle displacement. Not only is this true in the positive quadrant as represented by line 94 in FIG. 5, but is also true for the negative handle stroke as represented by line 96.

This increased range of valve operation is important when the variable displacement pump is used in a vehicle propulsion system. 27° of handle stroke may be utilized to control vehicle movement from zero speed to maximum speed as compared to the prior art device wherein only 16° of handle movement would provide this range of operation.

As can be ascertained from the aforesaid described structure, the object of providing a simple compensation means to reduce the fluid flow dead zone during valve operation has been obtained. Although this invention has been illustrated and described in connection with the particular embodiment illustrated, it will be apparent to those skilled in the art that various changes may be made therein without departing from the spirit of the invention as set forth in the appended claims.

I claim:

1. A control for a hydraulic valve having a movable flow control element, said flow control element having a neutral position prohibiting flow through said valve and requiring movement of an incremental amount before initiating flow through said valve, a valve control handle having a zero flow position and being operatingly connected to said flow control element by a variable resistance electric circuit having an output current proportional to the displacement of said control handle from said zero flow position and an electric motor connecting said electric circuit to said flow control element whereby an increase in current from said electric circuit causes proportional movement of said flow control element from said neutral position, and said means interposed between said control handle and said flow control element also including a resistor selectively connected to said circuit to substantially increase current output upon movement of said control handle to a predetermined displacement from said zero flow position whereby said substantial increase in current output causes a substantial increase in movement of said flow control element at a rate greater than said proportional movement of said flow control element.

2. The control of claim 1 whereby the connection of said resistor to said circuit reduces the ratio of proportional current flow to displacement of said control handle to extend the control range of operation by reducing the output current sensitivity to control handle displacement after said initial substantial increase of current output.

3. The control of claim 1 wherein said control handle has a full stroke operating range and wherein said predetermined displacement occurs within the first 20% of said full stroke operating range.

4. An electro hydraulic control circuit for an electrically controlled hydraulic valve having a flow control element movable between a neutral position preventing flow through said valve and a flow position permitting flow through said valve wherein said flow control element moves an incremental amount before flow through said valve begins, said electro hydraulic control circuit includes;

electric motor means for moving said flow control element from said neutral position to said flow position when electric current is supplied to said electric motor means and wherein the amount of movement of said flow control element is proportional to said electric current to modulate flow through said valve, an electric circuit means for controlling the amount of current supplied to said electric motor means, control positioning means for modulating the current output of said electric circuit means proportional to the displacement of said control positioning means, said control positioning means being displaceable between a zero output current position and a full current output position, said electric circuit means providing no current output when said control positioning means is in said zero output current position and providing sufficient current output to said electric motor means to move said flow control element to said flow position when said control positioning means is in said full current output position, the improvement comprising means in said electric circuit means for substantially increasing the current output of said electric circuit means upon a small movement of said control positioning means from said zero current output position, said substantial increase of current output being sufficient to move said valve element said incremental amount.

5. The electro hydraulic control circuit of claim 4 wherein said electric circuit means includes a variable resistor operated by said control positioning means and in series with said electric motor means so that varying the resistance of said variable resistor controls the current flow to said electric motor means to proportionately modulate the flow through said valve, said means substantially increasing current output to said electric motor being a second resistor selectively electrically connected to said circuit means upon said small movement of said control positioning means from said zero current output position.

6. The electro hydraulic control circuit of claim 5 wherein the connection of said second resistor to said circuit reduces the ratio of proportional current flow to displacement of said control positioning means to extend the control range of operation by reducing the output current sensitivity to control positioning means displacement after said initial substantial increase of current output.

7. The electro hydraulic control circuit of claim 4 wherein said electric circuit means includes two variable resistors forming a parallel bridge and having wipers positioned by said control positioning means, said electric motor means being connected across the wipers of said variable resistors, said control positioning means when in said zero current output position effective to null said bridge, movement of said control positioning means from said zero current output position increasing the resistance of one of said variable resistors while reducing the resistance of said other variable resistor to cause current output from said bridge through said wipers, and wherein said means substantially increasing current output includes a fixed resistor being selectively connected to one of said wipers upon said small movement of said control positioning means in a first direction and to the other of said wipers upon small movement of said control positioning means the opposite direction.

8. The electro hydraulic control circuit of claim 4 wherein said flow control element moves in two directions from said neutral position, flow control element movement in a first direction causes fluid flow in a first direction to a load and flow control element movement in a second direction cause fluid flow in an opposite direction to said load and each direction of movement requires incremental movement of said valve element before flow starts to said load, and wherein movement of said control positioning means in a positive direction induces current flow to said electric motor means to move said flow control element in said first direction and movement of said control positioning means in a negative direction induces current flow to move said flow control element in said second direction, small movement of said control positioning means in either direction from the zero current output position causing substantial current flow to move said flow control element said incremental amount.

9. An electro hydraulic control circuit for an electrically controlled hydraulic valve having a valve spool with a neutral position preventing flow through said valve and axially movable to modulatingly control flow through said valve wherein said valve spool moves an incremental amount from said neutral position to initiate flow through said valve, said electro hydraulic control circuit includes:

electric motor means for moving said valve spool from said neutral position proportionately to current supplied to electric motor, an electric circuit having a variable resistance, in series with said motor, a control handle having a zero flow position and operatingly connected to said variable resistance to modulate the output current from said electric circuit to said electric motor, the output current from said electric circuit being proportional to the displacement of said control handle from a zero flow position, resistance means selectively connected to said electric circuit upon a small degree of movement of said control handle from said zero flow position to provide a substantial increase in current flow sufficient to move said valve spool said incremental amount.

10. The electro hydraulic control circuit of claim 9 wherein said electric circuit means includes two variable resistors forming a parallel bridge and having wipers positioned by said control handle, said electric motor means being connected across the wipers of said variable resistors, said control handle when in said zero current output position effective to null said bridge, movement of said control handle from said zero current output position increasing the resistance of one of said variable resistors while reducing the resistance of said other variable resistor to cause current output from said bridge through said wipers, and wherein said means substantially increasing current output includes a resistor being selectively connected to one of said wipers upon said small movement of said control handle in a first direction and selectively connected to the other of said wipers upon small movement of said control handle the opposite direction.

11. The electro hydraulic control of claim 9 wherein said valve is hydraulically connected to servo cylinders of a variable displacement pump whereby movement of said control handle controls the displacement of said pump and wherein a small movement of said control handle quickly initiates a change in displacement of said pump.

12. A control for a hydraulic valve having a movable flow control element, said flow control element having a neutral position prohibiting flow through said valve and requiring movement of an incremental amount before initiating flow through said valve, a valve control input means having a zero flow position and being operatingly connected to said flow control element by an electric circuit having an output current proportional to the displacement of said control input means from said zero flow position and an electric motor connecting said electric circuit to said flow control element whereby an increase in current from said electric circuit causes proportional movement of said flow control element from said neutral position, and means interposed between said control input means and said flow control element including a resistor selectively connected to said circuit to substantially increase current output upon movement of said control input means to a predetermined displacement from said zero flow position whereby said substantial increase in current output causes a substantial increase in movement of said flow control element at a rate greater than said proportional movement of said flow control element.

13. The control of claim 12 whereby the connection of said resistor to said circuit reduces the ratio of proportional current flow to displacement of said control input means to extend the control range of operation by reducing the output current sensitivity to control input means displacement after said initial substantial increase of current output.

14. The control of claim 12 wherein said control input means has a full stroke operating range and wherein said predetermined displacement occurs within the first 20% of said full stroke operating range.

* * * * *